United States Patent [19]

Iwahashi

[11] Patent Number: 4,493,315

[45] Date of Patent: Jan. 15, 1985

[54] MASSAGE MEANS

[75] Inventor: Shoji Iwahashi, Kainan, Japan

[73] Assignee: Aisen Kogyo, Ltd., Wakayama, Japan

[21] Appl. No.: 401,049

[22] Filed: Jul. 22, 1982

[51] Int. Cl.[3] ..... A61H 7/00

[52] U.S. Cl. ..... 128/60; 128/67

[58] Field of Search ..... 128/54, 58, 59–62 R, 128/67

[56] References Cited

U.S. PATENT DOCUMENTS

| | | | |
|---|---|---|---|
| 718,594 | 1/1903 | Bailey | 128/58 X |
| 859,507 | 7/1907 | Murdock | 128/62 R |
| 2,168,975 | 8/1939 | Clarke | 128/62 R |
| 3,085,276 | 4/1963 | Swanson, Jr. | 128/62 R |
| 3,468,534 | 9/1969 | Donato | 272/128 |

FOREIGN PATENT DOCUMENTS

| | | | |
|---|---|---|---|
| 2711170 | 9/1978 | Fed. Rep. of Germany | 128/67 |
| 16500 | 8/1899 | United Kingdom | 128/59 |
| 702022 | 1/1954 | United Kingdom | 128/67 |

*Primary Examiner*—Richard J. Apley
*Assistant Examiner*—David J. Brown
*Attorney, Agent, or Firm*—Edwin E. Greigg

[57] ABSTRACT

A massage means utilizing a resilient deformable structure, comprising: a right-hand bar; a left-hand bar; an intermediate stick having one end joined to one end of the right-hand bar and the other end joined to one end of the left-hand bar, the center portion of the intermediate bar being made of a resilient material; and a pair of pressing members disposed at the both sides with respect to the center portion of the intermediate bar with a space provided therebetween in the longitudinal direction of the intermediate bar.

9 Claims, 5 Drawing Figures

MASSAGE MEANS

BACKGROUND OF THE INVENTION (1) Field of the Invention

The present invention relates to massage means with the use of which one can massage his shoulders or the like by himself.

(2) Description of the Prior Art

Patting and kneading a part of the body are typical massage methods. While these methods respectively produce different massage results on the muscles, kneading seems to be more effective than patting.

In order to manually realize such patting, there has been used, for example, a patting stick having a mallet at one end thereof. One can pat his shoulder with such patting stick held by the hand.

There has been available a device capable of mechanically patting and kneading a part of the body in a continuous manner with the use of an electric power. Such device is however of large scale and therefore very expensive.

On the other hand, there has not been made a manual means capable of easily kneading a part of the body.

Thus, there has been long waited a simple means with the use of which one can easily knead a part of his body, thereby to facilitate the circulation of the blood.

SUMMARY OF THE INVENTION

It is an object of the present invention to provide a manual massage means with the use of which one can knead a part of the body by himself without the aid of others.

A massage means in accordance with the present invention comprises a right-hand bar, a left-hand stick, an intermediate bar having one end joined to one end of the right-hand bar, and the other end joined to one end of the left-hand bar, at least the center portion of the intermediate stick being made of a resilient material, and a pair of pressing members attached to the intermediate bar at the both sides with respect to its center portion with a space provided therebetween in the longitudinal direction of the intermediate bar.

With the grips of this massage means held, a bending force is applied to the massage means such that the both pressing members approach each other. Then, the center portion of the intermediate bar made of a resilient material is bent, so that a pair of pressing members may push and hold the shoulder or the neck therebetween. When such bending force is released, the center portion of the intermediate bar is restored to the original shape by resiliency, so that the massage means is restored to the original shape.

By repeating such operations, the pressing members may strongly and easily give an effective massage to a part of the body such as the shoulder, the neck, and back and the hip which one cannot knead with his hands sufficiently or at all. Thus, the stiffness in the muscles at such part of the body may be relieved, thereby to facilitate the circulation of the blood.

When the pressing members are merely pressed to a part of the body without the repeat application of a bending force to the massage means with the grips held, an effect provided by a so-called finger pressure treatment may be obtained. Such effect different from the kneading effect may also relieve the stiffness in the muscles at that part, thereby to facilitate the circulation of the blood.

BRIEF DESCRIPTION OF THE DRAWINGS

The present invention will be further described, by way of example, with reference to the accompanying drawings, in which.

DETAILED DESCRIPTION OF THE PREFERRED EMBODIMENTS

Figures 1, 2, 3, 4, 5:
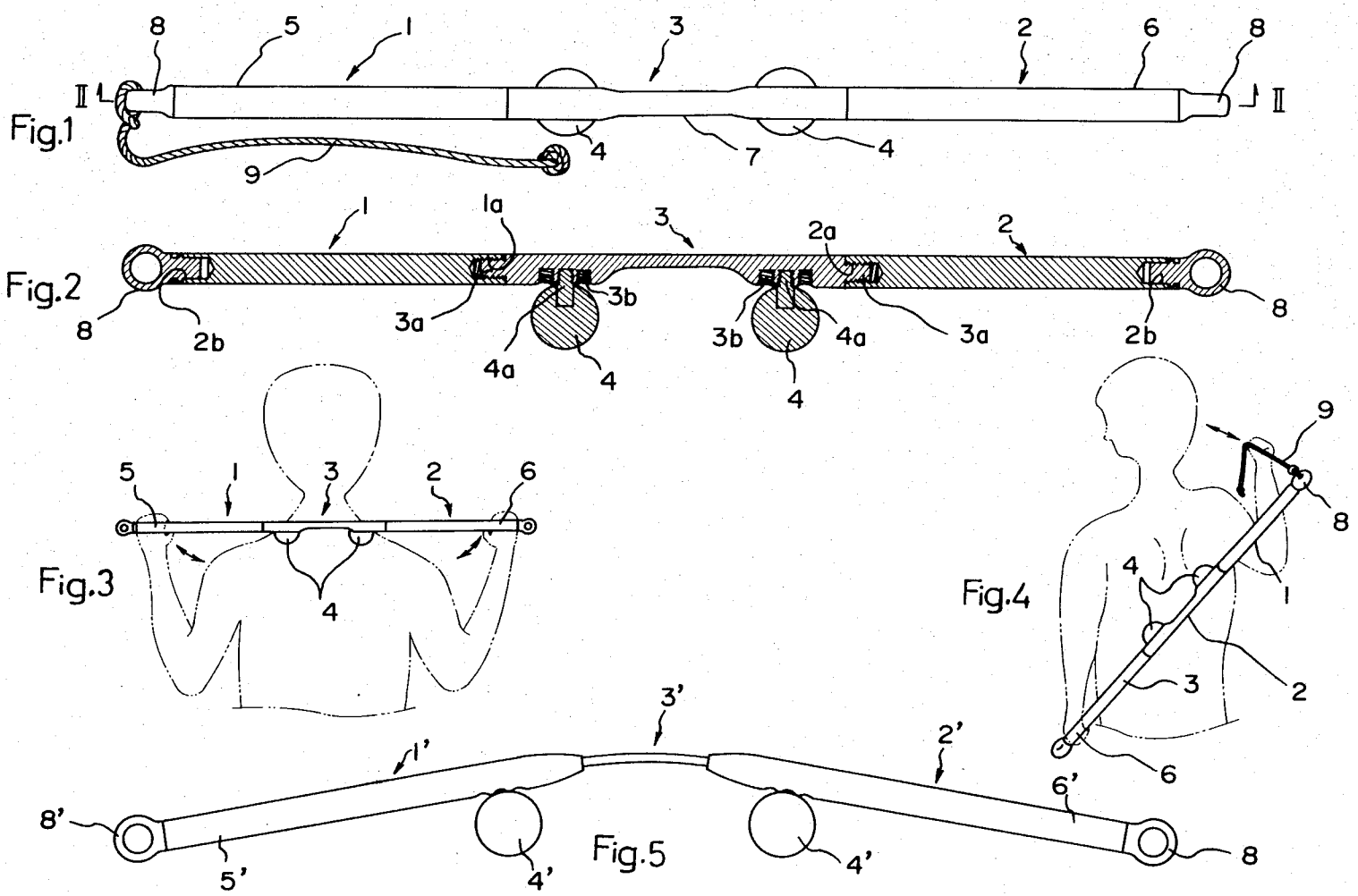
FIG. 1 is a plan view of a first embodiment of massage means in accordance with the present invention.
FIG. 2 is a section view taken along the line II—II in FIG. 1.
FIGS. 3 and 4 are views illustrating how to use the massage means in accordance with the present invention shown in FIG. 1.
FIG. 5 is a front view of a second embodiment of massage means in accordance with the present invention.

FIG. 1 illustrates a preferred embodiment of massage means in accordance with the present invention.

The massage means of the present invention comprises an intermediate resilient bar 3, left- and right-hand rigid bars 1 and 2 joined to the both ends of the intermediate bar 3, and a pair of pressing members attached to the intermediate bar 3. This massage means has such length that the grips 5 and 6 located respectively at the outer ends of the left- and right-hand bars 1 and 2 are easily grasped in the horizontal direction behind the neck with the both hands of the user.

The intermediate bar 3 has a band-shape center portion 7 of which the width is greater than its thickness such that the center portion 7 is easily bent only in one direction such that the pressing members secured to said resilient bar moves toward each other in the same plane and when released the bar returns to its natural state. Since the intermediate resilient bar is wider in width than in the thickness, the bar will be flexed only in the one direction.

A pair of pressing members 4 are attached to the intermediate bar 3 at the both sides with respect to the band-shape center portion 7 at the side of the large width face thereof. The intermediate bar 3 has at the both ends thereof external threads 3*a* which are threadedly connected to internal threads 1*a* and 2*a* respectively formed in the inner ends of the left- and right-hand bars 1 and 2.

Ring pins 8 are rotatably fitted into holes 1*b* and 2*b* in the outer ends of the left- and right-hand bars 1 and 2, in such a manner as not to come off from the holes 1*b* and 2*b*. A pulling rope 9 is connected to one of the ring pins 8.

The pressing members 4 are provided with studs which have external threads 4*a* which are threadedly connected to internal threads 3*b* in the intermediate bar 3. Three pairs of internal threads 3*b* are formed in the intermediate bar 3 in its longitudinal direction. A suitable pair of internal threads may be selected dependent on the size of the neck or a portion of the body to be kneaded.

The distance between the intermediate stick 3 and each of the pressing members 4 may be adjusted by adjusting the screwing depth of the external threads 4*a* of the pressing members 4.

While the left- and right-hand bars 1 and 2 may be made of an ABS resin, the intermediate bar 3 may be made of nylon and the pressing members 4 and the ring pins 8 may be made of a synthetic resin.

When, with the grips 5 and 6 held, a bending force is applied to the massage means such that the pressing members 4 approach each other as shown in FIG. 3, the center portion 7 of the intermediate bar 3 is bent, so that the shoulder or the neck are pressed by and/or held between the pressing members 4. Then, when such bending force applied to the massage means is released, the center portion 7 of the intermediate bar 3 is restored to the original shape, so that the massage means is restored to the original shape.

By repeating such operations, the pressing members 4 may strongly and easily produce an efficient massage on a part of the body such as the shoulder, the neck, the back or the hip which one cannot massage by himself sufficiently or at all. Accordingly, the stiffness in the muscles at such part of the body may be relieved, thereby to facilitate the circulation of the blood.

When the massage means of the present invention is used as inclined and the grip 6 is held with one hand and the pulling rope is held with the other hand as shown in FIG. 4, the massage means may be manipulated in an easier manner.

When the pressing members 4 are merely pressed to a part of the body without the repeat application of a bending force to the massage means with the grips 5 and 6 held, an effect provided by a so-called finger pressure treatment may be obtained. By such effect different from the kneading effect, the stiffness in the muscles at such part of the body may be relieved, resulting in a good circulation of the blood.

FIG. 5 illustrates a second embodiment of the massage means in accordance with the present invention.

In FIG. 5, the pressing members 4' are disposed at the inner ends of the left- and right-hand bars 1' and 2' made of an ABS resin, and a band-shape resilient member 3' made of nylon is disposed between the inner ends of the left- and right-hand bars 1' and 2'. The left- and right-hand bars 1' and 2' and the pressing members 4' may be formed in a unitary construction.

According to the massage means of the second embodiment, the band-shape resilient member 3' is already slightly curved in the bending direction in a state where no bending force is applied to the massage means.

Such curved structure may also be applied to the first embodiment of the present invention.

The band-shape resilient member 3' may be formed by combining two or three parallel rods with each other.

The left- and right-hand sticks, and the intermediate stick may be made of other material such as metal or fiber glass than the resins above-mentioned.

Besides a spherical shape, the pressing members may be formed in other shape including a semi-spherical shape, a columnar shape, a semi-columnar shape, a semi-cylindrical shape.

I claim:

1. A massage means comprising a rigid right hand bar, a rigid left hand bar and an intermediate bar disposed between and connected end-to-end to said rigid right hand bar and said rigid left hand bar, said intermediate bar, said right hand bar and said left hand bar each having a length which is longer than their width and a width that is greater than their thickness, said intermediate bar having thick end portions having the same thickness as said right and left hand bars separated by a mid-portion which is thinner and narrower than said end portions, a pair of spherical pressing members with one each secured to said thick end portions of said intermediate bar perpendicular to its thickness, said mid-portion of said intermediate bar being resilient so that said mid-portion of said intermediate bar bends in a direction such that said spherical pressing members are moved in a direction toward each other when said right hand and left hand bars are moved in a longitudinal plane in a direction toward said pressing members.

2. A massage means as set forth in claim 1 wherein said center portion of said intermediate bar comprises a band shaped portion which is easy to bend and has a length greater than a diameter of said spherical pressing members.

3. A massage means as set forth in claim 2 wherein each of said pressing members includes an external thread selectively engageable with a plurality of internal threads defined in each of said ends of said intermediate stick and spaced apart longitudinally of said intermediate stick, thereby rendering a distance between said pressing members and said intermediate stick variable.

4. The massage means as set forth in claim 1, wherein said intermediate bar has adjustable connecting means to connect said intermediate bar to said rigid right hand bar and said rigid left hand bar so that the distance between each of the pressing members and the ends of said right and left hand bars are adjustable by threading said right and left hand bars into or out of said intermediate bar.

5. The massage means as set forth in claim 1, wherein the right- and left-hand bars are removably secured to the intermediate bar at the both ends thereof.

6. The massage means as set forth in claim 1, wherein at least one of the right- and left-hand bars has a ring pin.

7. The massage means as set forth in claim 6, further comprising a pulling rope attached to the ring pin.

8. The massage means as set forth in claim 1, wherein the intermediate bar has a center portion which is slightly curved in the bending direction in a state where no bending force is applied thereto.

9. The massage means as set forth in claim 1, wherein the intermediate bar is made of nylon in a unitary construction, and the right- and left-hand bars are made of an ABS resin.

* * * * *